United States Patent [19]

Joseph et al.

[11] 4,196,001

[45] Apr. 1, 1980

[54] ANTISTATIC LAYER FOR PHOTOGRAPHIC ELEMENTS

[75] Inventors: Douglas C. Joseph, Victor; Ronald L. Hartman, Rochester, both of N.Y.

[73] Assignee: Eastman Kodak Company, Rochester, N.Y.

[21] Appl. No.: 569,233

[22] Filed: Apr. 16, 1975

Related U.S. Application Data

[63] Continuation-in-part of Ser. No. 491,414, Jul. 24, 1974, abandoned.

[51] Int. Cl.[2] ..... G03C 1/78; G03C 1/96; H01B 1/06

[52] U.S. Cl. .....430/502; 452/510; 427/202; 428/900; 427/393.1/430/538

[58] Field of Search ..... 96/87 A, 168, 87 R, 96/85; 252/500, 510; 427/128, 202, 390 B; 428/900

[56] References Cited

U.S. PATENT DOCUMENTS

| | | | |
|---|---|---|---|
| 2,725,297 | 11/1955 | Morey | 96/87 A |
| 3,437,484 | 4/1969 | Nadeau | 96/87 A |
| 3,552,972 | 1/1971 | Meyer et al. | 96/87 A |
| 3,574,682 | 4/1971 | Honjo et al. | 96/87 A |
| 3,769,020 | 10/1933 | Verberg | 96/87 A |
| 3,786,002 | 1/1974 | Van Paeschen et al. | 96/87 A |
| 3,793,029 | 2/1974 | Parker | 96/87 A |

*Primary Examiner*—Jack P. Brammer
*Attorney, Agent, or Firm*—A. P. Lorenzo

[57] ABSTRACT

Photographic elements are protected against the adverse effects resulting from accumulation of static electrical charges by incorporating in the element an antistatic layer formed from an aqueous coating composition containing a water-soluble film-forming polymeric anionic polyelectrolyte in free acid form, a water-soluble film-forming cross-linkage polymeric binder, and an acid-acting cross-linking agent for the polymeric binder. The antistatic layer is useful with both photographic films and photographic papers employed in black-and-white photography or in color photography and will function as an effective anticurl layer as well as providing excellent protection against static. It is durable, abrasion resistant, non-tacky and highly resistant to the aqueous processing baths employed in photographic processing.

30 Claims, 4 Drawing Figures

ANTISTATIC LAYER FOR PHOTOGRAPHIC ELEMENTS

Figure 1:
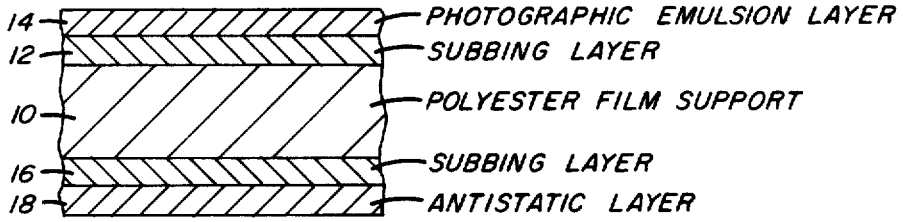

This is a continuation-in-part of application Ser. No. 491,414 filed July 24, 1974, and now abandoned.

This invention relates in general to photography and in particular to improved photographic elements containing a novel antistatic layer. More specifically, this invention relates to a novel antistatic coating composition and to its use in providing protection for photographic elements, such as photographic papers and films, from the adverse effects of static.

The accumulation of static electrical charges on photographic films and photographic papers has long been a serious problem in the photographic arts. These charges arise from a variety of factors during the manufacture, handling and use of photographic recording materials. For example, they can occur on photographic sensitizing equipment and on slitting and spooling equipment, and can arise when the paper or film is unwound from a roll or as a result of contact with transport rollers. The generation of static is affected by the conductivity and moisture content of the photographic material and by the atmospheric conditions under which the material is handled. The degree to which protection against the adverse effects of static is needed is dependent on the nature of the particular photographic element. Thus, elements utilizing high speed emulsions have a particularly acute need for antistatic protection. Accumulation of static charges can cause irregular fog patterns in a photographic emulsion layer and this is an especially severe problem with high speed emulsions. Static charges are also undesirable because they attract dirt to the photographic recording material and this can cause repellency spots, desensitization, fog and physical defects.

To overcome the adverse effects resulting from accumulation of static electrical charges, it is conventional practice to include an antistatic layer in photographic elements. Typically, such antistatic layers are composed of materials which dissipate the electrical charge by providing a conducting surface. A large number of different materials have been proposed heretofore for use in antistatic layers of photographic elements. For example, U.S. Pat. No. 2,649,374 describes a photographic film comprising an antistatic layer in which the antistatic agent is the sodium salt of a condensation product of formaldehyde and naphthalene sulfonic acid. An antistatic layer comprising an alkali metal salt of a copolymer of styrene and styrylundecanoic acid is disclosed in U.S. Pat. No. 3,033,679. Photographic films having an antistatic layer containing a metal halide, such as sodium chloride or potassium chloride, as the conducting material, a polyvinyl alcohol binder, a hardener, and a matting agent are described in U.S. Pat. No. 3,437,484. In U.S. Pat. No. 3,525,621, the antistatic layer is comprised of colloidal silica and an organic antistatic agent, such as an alkali metal salt of an alkylaryl polyether sulfonate, an alkali metal salt of an arylsulfonic acid, or an alkali metal salt of a polymeric carboxylic acid. Use in an antistatic layer of a combination of an anionic film-forming polyelectrolyte, colloidal silica and a polyalkylene oxide is disclosed in U.S. Pat. No. 3,630,740. In U.S. Pat. No. 3,681,070, an antistatic layer is described in which the antistatic agent is a copolymer of styrene and styrene sulfonic acid.

Photographic elements provided with antistatic layers in accordance with the prior art have suffered from one or more significant disadvantages. Thus, for example, in certain instances the antistatic layer has provided inadequate protection against static for high speed emulsions, such as those which are used in phototypesetting papers. Inability of the antistatic layer to withstand photographic processing baths, which can involve temperatures of 120° F. and higher, and consequent leaching of the components of the antistatic layer into the processing baths to form an undesirable sludge is also a serious problem. In some instances, the ingredients present in prior art antistatic coating compositions have not been water-soluble and thus the advantages of applying the layer by aqueous coating techniques could not be realized. Yet another disadvantage of certain prior art antistatic coating compositions is their inability to provide an antistatic layer which is durable, abrasion resistant and strongly adherent to the support, with the result that manufacturing equipment employed in production of the photographic element is contaminated with the antistatic materials. Equally significant is the disadvantage of some previously proposed antistatic layers resulting from the fact that the layer is not sufficiently non-tacky and, consequently, blocking can occur when the photographic film or paper is utilized in roll form.

It is toward the objective of providing a novel antistatic coating composition which overcomes the disadvantages of antistatic coating compositions known heretofore, and of providing photographic elements protected with an antistatic layer formed from such composition, that the present invention is directed.

The photographic elements of this invention are comprised of a support, at least one radiation-sensitive image-forming layer, and an antistatic layer comprising:

(a) a water-soluble film-forming polymeric anionic polyelectrolyte in free acid form;

(b) a water-soluble film-forming cross-linkable polymeric binder; and (c) an acid-acting cross-linking agent for said polymeric binder.

While form-forming, anionic polyelectrolytes have been used heretofore to provide static protection for photographic elements, in the present invention the polyelectrolyte is utilized in the free acid form and is employed in combination with a cross-linkable polymeric binder and a cross-linking agent for the binder. This combination of materials has been unexpectedly found to provide an antistatic layer which is not only highly effective in providing protection against the adverse effects of static but is highly resistant to the aqueous processing baths employed in processing of the element. Moreover, the antistatic layer of this invention provides important additional advantages, including the advantage that it can be coated from aqueous solution and the fact that it is durable, strongly adherent to the support, abrasion resistant and non-tacky, so that it does not contaminate equipment employed in manufacture of the photographic element nor processing baths used in processing of the photographic element.

While applicants do not wish to be bound by any theoretical explanation for the manner in which their invention functions, it is believed that chemical interaction occurs between all three essential ingredients of the antistatic layer and that the anionic polyelectrolyte becomes entangled in the cross-linked binder matrix. This apparently accounts for the remarkable resistance which the polyelectrolyte exhibits with respect to leaching from the antistatic layer by photographic processing solutions.

Photographic elements which can be protected from the adverse effects of static with the antistatic layers described herein include photographic films prepared from a variety of support materials. For example, the film support can be cellulose nitrate film, cellulose acetate film, polyvinyl acetal film, polycarbonate film, polystyrene film, or polyester film. Polyester films, especially biaxially stretched and heat-set polyethylene terephthalate film, are especially useful. Photographic papers, especially those coated on one or both sides with a coating of a hydrophobic polymeric materials, are also advantageously protected against static with the antistatic layers of this invention. Such polymer-coated photographic papers are well known and include papers coated with styrene polymers, cellulose ester polymers, linear polyesters, and polyolefins such as polyethylene or polypropylene.

The antistatic layers of this invention are usefully employed in photographic elements intended for use in black-and-white photography and in photographic elements intended for use in color photography. In addition to the antistatic layer and one or more radiation-sensitive image-forming layers, the photographic elements can include subbing layers, pelloid protective layers, filter layers, antihalation layers, and so forth. The radiation-sensitive image-forming layers present in the photographic elements can contain any of the conventional silver halides as the radiation-sensitive material, for example, silver chloride, silver bromide, silver bromoiodide, silver chlorobromide, silver chloroiodide, silver chlorobromoiodide, and mixtures thereof. Typically, these layers also contain a hydrophilic colloid. Illustrative examples of such colloids are proteins such as gelatin, protein derivatives, cellulose derivatives, polysaccharides such as starch, sugars such as dextran, plant gums, and synthetic polymers such as polyvinyl alcohol, polyacrylamide and polyvinylpyrolidone. Conventional addenda such as antifoggants, stabilizers, sensitizers, development modifiers, developing agents, hardeners, plasticizers, coating aids, and so forth, can also be included in the photographic emulsion layers. The photographic elements protected with the antistatic layer of this invention can be films or papers sensitized with a black-and-white emulsion, elements designed for reversal color processing, negative color elements, color print materials, and the like.

One of the three essential components of the antistatic coating compositions of this invention is a water-soluble film-forming polymeric anionic polyelectrolyte in free acid form. This material serves two functions in the antistatic layer. First, it provides the necessary conductivity to render the layer effective as an antistatic layer. Secondly, it functions as an acid catalyst in the cross-linking of the polymeric binder by the acid-acting cross-linking agent. A wide variety of polymeric anionic polyelectrolytes which are water-soluble and film-forming and, accordingly, useful for the purposes of this invention, are known. Particularly useful materials are polymeric sulfonic acids and especially polystyrene sulfonic acid. Examples of other useful materials include the following:

polyvinyl sulfonic acid,
polyacrylic acid,
polymethacrylic acid,
copolymer of vinyl methyl ether and maleic anhydride (at least partially converted to free acid form),
copolymer of vinyl ethyl ether and maleic anhydride (at least partially converted to free acid form),
copolymer of maleic anhydride and styrene (at least partially converted to free acid form),
copolymer of itaconic acid and styrene,
copolymer of crotonic acid and styrene,
copolymer of citraconic acid and methyl acrylate,
polyvinyl phosphonic acid,
and the like.

It should be especially noted that, in this invention, the anionic polyelectrolyte is utilized in free acid form and not in the form of an alkali metal salt, as has commonly been the case in antistatic layers known prior to this invention.

The second of the three essential components of the antistatic coating compositions of this invention is a water-soluble film-forming cross-linkable polymeric binder. This material does not contribute significantly to the conductivity of the antistatic layer but functions in combination with the cross-linking agent and the polymeric anionic polyelectrolyte to form a durable, water-insoluble layer from which substantially no leaching of material occurs during processing of the photographic element. A wide variety of water-soluble film-forming polymeric binders which are cross-linkable and, accordingly, useful for the purposes of this invention, are known. A particularly useful material is polyvinyl alcohol. Examples of other useful materials include the following:

polyacrylamide,
polyvinyl pyrrolidone,
copolymer of acrylamide and vinyl acetate,
hydroxymethyl cellulose,
hydroxyethyl cellulose,
hydroxymethyl hydroxyethyl cellulose,
and the like.

The third of the three essential components of the antistatic coating compositions of this invention is an acid-acting cross-linking agent for the cross-linkable polymeric binder. The cross-linking agent must be acid-acting, that is, capable of functioning under acidic conditions, so that it will cross-link the cross-linkable polymeric binder under the acidic conditions imparted to the antistatic layer by the polymeric anionic polyelectrolyte. A wide variety of such cross-linking agents are known. Glyoxal is a particularly useful material for this purpose. Examples of other useful materials include the following:

melamine-formaldehyde resins,
urea-formaldehyde resins,
tetra ethyldortho silicate,
dialdehyde starch,
zirconium nitrate,
2,3-dihydroxy-1,4-dioxane,
glutaraldehyde,
trimethylol phenol,
and the like.

A particularly effective antistatic coating composition within the scope of this invention is one comprising polystyrene sulfonic acid, polyvinyl alcohol and glyoxal. The polystyrene sulfonic acid preferably has a molecular weight in the range from about 20,000 to about 100,000 and most preferably in the range from about 37,000 to about 40,000. The molecular weight of the polyvinyl alcohol is preferably in the range from about 20,000 to about 222,000 and most preferably in the range from about 25,000 to about 35,000, while the residual acetyl content of the polyvinyl alcohol is preferably in the range from about 1% to about 20%.

The proportions of the ingredients making up the antistatic coating compositions of this invention can be varied widely to meet the requirements of the particular element which is to be provided with antistatic protection. Typically, the polymeric anionic polyelectrolyte will be employed in an amount of about 30 to about 75 percent by weight, based on the total dry solids content of the coating composition, and preferably in an amount of about 38 to about 55 percent by weight. The cross-linkable polymeric binder is typically employed in an amount of about 30 to about 70 percent by weight, based on the total dry solids content of the coating composition, and preferably in an amount of about 34 to about 55 percent by weight. Suitable amounts of cross-linking agent are typically in the range of about 0.02 to about 0.30 parts per part by weight of the cross-linkable polymeric binder and most preferably in the range from about 0.05 to about 0.28 parts per part by weight.

The generation of static charge on photographic elements is affected by the rate of contact electrification due to friction and by the conductivity of the element, which controls the rate of dissipation of the charge. To avoid static, the dissipation rate must be greater than the electrification rate. The effectiveness of antistatic layers is determined by calculating the surface resistivity at specific conditions of temperature and humidity and the value for the surface resistivity is typically reported in log ohms. A polyethylene coated photographic paper, such as is commonly used as a photographic support, will typically have a surface resistivity of 16 log ohms. Coating of the polyethylene layer with an antistatic layer of the composition described herein will typically reduce this value to as little as 10 log ohms, or less.

The antistatic coating composition can be applied by any suitable technique for the application of aqueous coating compositions. For example, it can be coated by spray coating, dip coating, swirl coating, extrusion hopper coating, curtain coating, air knife coating, or other coating technique. The thickness of the coated layer will depend upon the particular requirements of the photographic element involved. Typically, the dry weight coverage should be in the range from about 0.25 to about 4 grams per square meter and most usually in the range from about 1 to about 3 grams per square meter. Drying of the coated layer can be carried out over a wide range of temperatures, for example at temperatures of from about 75° F. to about 260° F. and more preferably from about 170° F. to about 235° F.

The accompanying drawing illustrates, by means of sectional views, photographic elements within the scope of the present invention.

As shown in FIG. 1, a polyester film support 10 has coated on the face side thereof a subbing layer 12 over which is coated a radiation-sensitive photographic emulsion layer 14. On the opposite side, the film support 10 is coated with subbing layer 16 over which is coated antistatic layer 18 formed from an antistatic coating composition as described herein.

Figure 2:
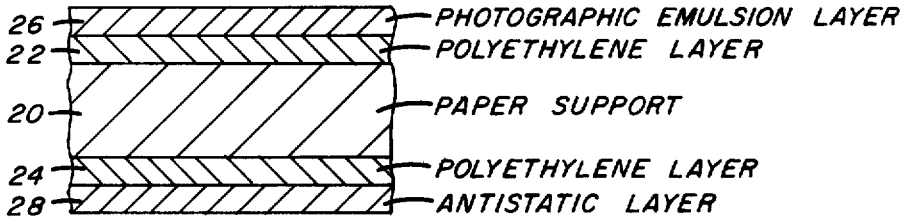

FIG. 2 illustrates a black-and-white photographic paper comprised of paper support 20 coated on each side thereof with polyethylene layers 22 and 24 and having a radiation-sensitive photographic emulsion layer 26 over polyethylene layer 22 and an antistatic layer 28 of the present invention coated over polyethylene layer 24.

Figure 3:
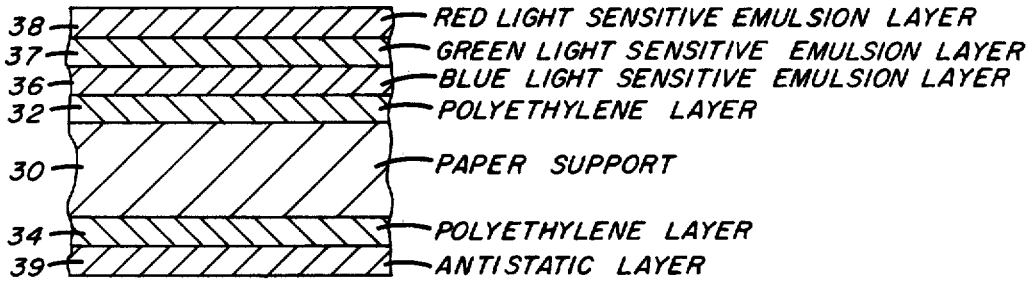

FIG. 3 illustrates a color photographic paper comprised of paper support 30 coated on each side thereof with polyethylene layers 32 and 34. The polyethylene layer 32 is overcoated with photographic emulsion layers 36, 37 and 38 which are respectively a blue light sensitive emulsion layer, a green light sensitive emulsion layer and a red light sensitive emulsion layer, and polyethylene layer 34 is overcoated with antistatic layer 39 which has a composition as described herein.

Figure 4:
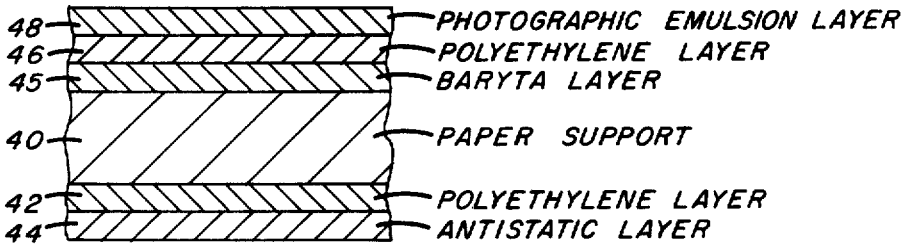

FIG. 4 illustrates a black-and-white photographic paper comprised of paper support 40 coated on one side thereof with polyethylene layer 42 and antistatic layer 44 having a composition as described herein. On its opposite side paper support 40 is coated with baryta layer 45 which has been treated with a priming agent, polyethylene layer 46, and a radiation-sensitive photographic emulsion layer 48.

The antistatic coating compositions of this invention can contain other ingredients in addition to the anionic polyelectrolyte, the polymeric binder and the cross-linking agent. For example, they can contain matting agents such as starch, titanium dioxide, zinc oxide, calcium carbonate, barium sulfate, colloidal silica or polymeric beads such as polymethyl methacrylate beads. Colloidal silica with a particle size of about 4 millimicrons to about 30 microns is particularly useful for this purpose. Surfactants can be included in the composition as coating aids and, if the composition is to be applied by gravure coating techniques, it will be advantageous to include a lower aliphatic alcohol, such as butyl alcohol, to facilitate coating.

If desired, colloidal silica can be included in the antistatic coating composition in amounts such that it represents a major proportion of the total weight of the composition, for example, in amounts of as much as 60 percent of the composition on a dry weight basis. This provides a cost saving and has been found to give satisfactory results as regards static protection, durability and resistance to photographic processing solutions even at a dry weight coverage as low as 0.5 grams per square meter.

When the antistatic coating composition of this invention is applied to a polyolefin coated paper support, it is advantageous to treat the polyolefin surface, by a suitable method such as corona discharge treatment, to render it receptive to the coating compositions. Methods of employing corona discharge treatment for this purpose are well known to the photographic art. It may also be advantageous for the paper which is used to prepare the support to be tub sized with a solution of a conducting salt which acts as an internal antistat.

When the antistatic coating composition of this invention is applied to a polyester film support, a subbing layer is advantageously employed to improve the bonding of the antistatic layer to the support. Useful subbing compositions for this purpose are well known to the art and include, for example, interpolymers of vinylidene chloride such as vinylidene chloride/acrylonitrile/acrylic acid terpolymers or vinylidene chloride/methyl acrylate/itaconic acid terpolymers.

The antistatic layers of this invention can be incorporated at any position within a photographic element to provide effective protection against the adverse effects of static. However, they will ordinarily be employed as the outermost layer of the element on the side opposite the radiation-sensitive photographic emulsion layers.

With photographic elements in which the support is a polymer coated paper support, such as polyethylene-coated paper, the curl which takes place before, during or after processing can be of critical significance. Curl induced in the support before extrusion coating of the polyethylene layer and curl caused by the gelatin of the photographic emulsion layer can cause processing transport and handling problems. The antistatic layer of this invention produces a curl force that counteracts the curl produced by the gelatin of the emulsion layer and thus the element remains flat throughout the processing steps.

In one embodiment of this invention, the photographic element is one in which the photographic emulsion layer or a layer adjacent thereto contains a silver halide developing agent. Such elements are well known to the art. The useful developing agents for this purpose include hydroquinones, catechols, aminophenols, 3-pyrazolidones, ascorbic acid and its derivatives, reductones, and phenylenediamines. Combinations of these developing agents are frequently employed in elements of this type, such as a combination of hydroquinone and a 3-pyrazolidone. When the antistatic layers of this invention are employed with photographic elements of this type it is desirable that they include an agent to reduce the staining which can occur when the antistatic layer comes in contact with the emulsion layer, for example, when the photographic element is manufactured and stored in roll form. It has been found that a yellow stain tends to form in the antistatic layer and it is believed that such stain is due to interaction between the developing agent present in the element and the anionic polyelectrolyte present in the antistatic layer. It has further been found that the addition of ammonium hydroxide or an alkali metal hydroxide to partially neutralize the free acid form of the anionic polyelectrolyte greatly reduces the staining which occurs. However, this can adversely affect the surface resistivity characteristics of the antistatic layer so that the ammonium hydroxide or alkali metal hydroxide should not be used in excessive amounts. It should always be used in amounts less than will provide complete neutralization, as the presence of anionic polyelectrolyte in free acid form is necessary to obtain the desirable combination of properties possessed by the antistatic layers of this invention. Tin salts, and particularly the stannous halides such as stannous chloride, stannous bromide or stannous fluoride, have also been found to be effective in reducing the staining. A combination of stannous chloride and ammonium hydroxide is especially effective in reducing staining in an antistatic layer containing polystyrene sulfonic acid and this is a preferred composition within the scope of the present invention for use with emulsions containing incorporated developing agents.

Effective protection against staining can also be obtained by incorporating small quantities of hydrogen peroxide in the antistatic coating composition. Preferred amounts are from about 0.0001 to about 0.01 parts of hydrogen peroxide per part by weight of the anionic polyelectrolyte. The hydrogen peroxide is effective in reducing staining yet has little or no adverse effect on the surface resistivity of the antistatic layer. In comparing hydrogen peroxide with the stannous halides for use as an anti-staining agent in the antistatic compositions of this invention, it has been found that photographic emulsion layers can exhibit a sensitivity to the reducing potential of stannous halides and that this can cause detrimental results in the form of a defect in the photographic element which is referred to as "black spots". Thus, for example, transfer of minute amounts of the antistatic coating from the back to the face of the support can occur during manufacture and upon subsequent coating of the photographic emulsion layer on the face side of the support a small black spot can appear at points where the antistatic composition is present. This defect does not occur when hydrogen peroxide is used as the anti-staining agent. Since hydrogen peroxide provides good anti-staining protection, does not adversely affect resistivity to a significant extent, and does not cause black spots, antistatic compositions containing hydrogen peroxide represent a particularly preferred embodiment of this invention. To obtain a desirable balance between the requirement of good antistatic protection and the need to minimize stain formation, it is especially advantageous to use a combination of hydrogen peroxide and a hydroxide, such as ammonium hydroxide or an alkali metal hydroxide.

The invention is further illustrated by the following examples of its practice.

EXAMPLE 1

An antistatic coating composition was prepared in accordance with the following formulation:

| Ingredient | Parts by Weight |
|---|---|
| Polystyrene sulfonic acid (10% by weight aqueous solution) | 20 |
| Polyvinyl alcohol (10% by weight aqueous solution of 99% hydrolyzed polymer) | 20 |
| Glyoxal (10% by weight aqueous solution) | 1 |
| Water | 59 |
| | 100 |

Photographic supports were prepared by applying the above-described antistatic coating composition to polyethylene-coated paper that had been subjected to corona discharge treatment to enhance the receptivity of the polyethylene surface to coating compositions. Tests were carried out in which the antistatic coating composition was coated in an amount sufficient to provide dry weight coverages ranging from 1.0 to 2.0 grams per square meter and dried at temperatures of 150° F. to 190° F. The antistatic layer obtained was found to have a surface resistivity of 9.7 log ohms at 20% relative humidity and a temperature of 73° F. It was also found to be durable, abrasion-resistant and non-tacky and to be insoluble in water and in photographic processing solutions. Substantially no leaching of the polystyrene sulfonic acid from the antistatic layer took place even when the element was subjected to photographic processing baths maintained at a temperature of 120° F.

The surface resistivity of the antistatic layer was also measured at other levels of relative humidity and results obtained were as follows:

| Relative Humidity (%) | Surface Resistivity (log ohms) |
|---|---|
| 10 | 10.3 |
| 42 | 8.4 |

-continued

| Relative Humidity (%) | Surface Resistivity (log ohms) |
|---|---|
| 50 | 7.9 |
| 70 | 6.3 |

EXAMPLE 2

An antistatic coating composition was prepared in accordance with the following formulation:

| Ingredient | Parts by Weight |
|---|---|
| Polystyrene sulfonic acid (10% by weight aqueous solution) | 35 |
| Polyvinyl alcohol (10% by weight aqueous solution of 99% hydrolyzed polymer) | 35 |
| Partially hydrolyzed tetraethyl ortho silicate (24% by weight aqueous solution) | 4 |
| Water | 26 |
| | 100 |

Photographic supports were prepared by coating a biaxially stretched and heat-set polyethylene terephthalate film with a subbing composition containing a vinylidene chloride, methyl acrylate, itaconic acid terpolymer, drying, and over-coating the subbing layer with the above-described antistatic coating composition. Tests were carried out in which the antistatic coating composition was coated in an amount sufficient to provide dry weight coverages ranging from 0.25 to 2.0 grams per square meter and dried at temperatures of 100° F. to 170° F. The antistatic layer obtained was found to have a surface resistivity of 10.0 log ohms at 20% relative humidity and a temperature of 73° F. It adhered strongly to the subbed polyethylene terephthalate and was durable, abrasion resistant, nontacky, and insoluble in photographic processing solutions.

Similar results were obtained using a corona discharge treated polycarbonate film in place of the subbed polyethylene terephthalate film.

EXAMPLE 3

An antistatic coating composition was prepared in accordance with the following formulation:

| Ingredient | Parts by Weight |
|---|---|
| Polystyrene sulfonic acid (18% by weight aqueous solution) | 32 |
| Polyvinyl alcohol (20% by weight aqueous solution of 87% hydrolyzed polymer) | 30 |
| Glyoxal (10% by weight aqueous solution) | 3 |
| Barium sulfate (59% by weight aqueous solution) | 3.4 |
| Colloidal silica | 2 |
| Isobutyl alcohol | 8 |
| Water | 21.6 |
| | 100 |

A phototypesetting photographic paper was prepared as follows:

(1) Photographic paper having a basis weight of 16 pounds per 1000 $ft^2$ was tub sized with sodium formaldehyde bisulfite;

(2) The wire side of the paper was treated by corona discharge;

(3) The corona-discharge-treated surface was extrusion coated with 2.5 lbs per 1000 $ft^2$ of high density polyethylene resin;

(4) The polyethylene coating was treated by corona discharge;

(5) The corona-discharge-treated polyethylene surface was gravure coated at 3 grams per square meter with the above-described antistatic coating composition;

(6) The element was dried at a temperature of 180° F. to 230° F.;

(7) The face side of the paper was treated by corona discharge;

(8) The corona-discharge-treated face side was extrusion coated with 2.5 lbs per 1000 $ft^2$ of low density polyethylene pigmented with titanium dioxide;

(9) The polyethylene coating on the face side was treated by corona discharge; and

(10) A black-and-white gelatino-silver halide photographic emulsion was applied to the face side polyethylene layer.

The antistatic layer of the above-described photographic element was found to have a surface resistivity of 9.2 log ohms at 20% relative humidity and a temperature of 73° F. It was durable, abrasion resistant, nontacky and insoluble in processing baths, including processing baths maintained at elevated temperatures such as 120° F. The barium sulfate and colloidal silica provided adequate "tooth" to permit writing on the back of the element. The antistatic layer provided effective protection against the adverse effects of static and also functioned as an anticurl layer to produce a curl force that counteracts the curl produced by the gelatin emulsion layer. As a result of the anticurl properties of the antistatic layer, the phototypesetting paper can be processed in roller transport processors without jamming of the processor and the prints emerge from the processor in a flat condition and remain flat through the conditions of temperature and humidity normally encountered.

EXAMPLE 4

The antistatic coating composition described in Example 3 above was used to form an antistatic layer for a photographic element utilized in the graphic arts industry. The element was prepared as follows:

(1) Photographic paper having a basis weight of 15.75 pounds per 1000 $ft^2$ was coated with a baryta coating at a coverage of 22 grams per square meter.

(2) The baryta layer was primed with polyethyleneimine applied by a gravure coater.

(3) The wire side of the paper was treated by corona discharge.

(4) The corona-discharge-treated surface was extrusion coated with 5.5 pounds per 1000 $ft^2$ of high density polyethylene.

(5) The polyethylene layer was treated by corona discharge.

(6) The corona-discharge-treated polyethylene surface was gravure coated at 3 grams per square meter with the antistatic coating composition described in Example 3.

(7) The element was dried at a temperature of 230° F.

(8) A low density polyethylene coating was extrusion coated over the primed baryta layer at a coverage of 2.5 pounds per 1000 $ft^2$.

(9) The low density polyethylene layer was treated by corona discharge.

(10) A black-and-white gelatino silver halide photographic emulsion was applied over the low density polyethylene layer.

The antistatic layer was found to provide excellent antistatic protection for the element and also to provide anticurl properties which enabled the element to be processed in a roller transport processor without jamming.

EXAMPLE 5

An antistatic coating composition was prepared in accordance with the following formulation:

| Ingredient | Parts by Weight |
|---|---|
| Polystyrene sulfonic acid | 9 |
| Polyvinyl alcohol (88% hydrolyzed) | 8 |
| Glyoxal | 0.4 |
| Colloidal silica | 3 |
| Ammonium hydroxide | 2 |
| Stannous chloride | 1 |
| Butyl alcohol | 9.6 |
| Water | 67 |
| | 100 |

A phototypesetting photographic paper was prepared as follows:

(1) Photographic paper having a basis weight of 16 pounds per 1000 $ft^2$ was treated by corona discharge on the wire side.

(2) The corona-discharge-treated surface was extrusion coated with 2.5 pounds per 1000 $ft^2$ of high density polyethylene resin.

(3) The polyethylene coating was treated by corona discharge.

(4) The corona-discharge-treated polyethylene surface was gravure coated at 2.6 to 3.0 grams per square meter with the above-described antistatic coating composition.

(5) The element was dried at a temperature of 235° F.

(6) The face side of the paper was treated by corona discharge.

(7) The corona-discharge-treated face side was extrusion coated with 2.5 pounds per 1000 $ft^2$ of low density polyethylene pigmented with titanium dioxide.

(8) The polyethylene coating on the face side was treated by corona discharge.

(9) A black-and-white gelatino silver halide photographic emulsion containing an incorporated developing agent was applied to the face side polyethylene layer.

The antistatic layer of the above-described photographic element was found to have a surface resistivity of 9.9 to 10.3 log ohms at 20% relative humidity and 73° F. It was durable, abrasion resistant, non-tacky and insoluble in processing baths. The incorporation of ammonium hydroxide and stannous chloride in the antistatic coating composition provided good protection against staining resulting from storage of the material in roll form in which the emulsion layer contacts the antistatic layer.

The effect on surface resistivity of partially neutralizing the polystyrene sulfonic acid by incorporating sodium hydroxide or ammonium hydroxide or stannous chloride in the antistatic coating composition is shown in the following table:

| Neutralizing Agent | % Neutralization | Surface Resistivity (Log ohms) |
|---|---|---|
| None | None | 9.5 |
| Sodium hydroxide | 11.5 | 9.7 |
| Sodium hydroxide | 22.9 | 10.2 |
| Sodium hydroxide | 34.4 | 10.4 |
| Sodium hydroxide | 45.4 | 10.8 |
| Sodium hydroxide | 90.9 | 11.5 |
| Ammonium hydroxide | 11.5 | 10.0 |
| Ammonium hydroxide | 22.9 | 10.3 |
| Ammonium hydroxide | 34.4 | 10.7 |
| Ammonium hydroxide | 45.4 | 11.1 |
| Ammonium hydroxide | 90.9 | 11.4 |
| Stannous chloride | 24.5 | 9.7 |

As is apparent from consideration of the above results, when using an alkaline agent or a tin salt to reduce staining, it should not be used in too great an amount or the surface resistivity characteristics of the antistatic layer will be adversely affected. The amount employed should be chosen to provide an optimum balance between the need for low surface resistivity and the need for freedom from staining.

EXAMPLE 6

An antistatic coating composition was prepared in accordance with the following formulation:

| Ingredient | Parts by Weight |
|---|---|
| Polystyrene sulfonic acid | 2.0 |
| Polyvinyl alcohol (99% hydrolyzed) | 2.0 |
| Colloidal silica | 6.0 |
| Glyoxal | 0.1 |
| Isobutyl alcohol | 9.6 |
| Water | 80.3 |
| | 100.0 |

Photographic supports were prepared and tested in the same manner as described in Example 1 using a dry weight coverage of the above-described antistatic coating composition of 0.5 grams per square meter. Properties similar to those described in Example 1 were obtained.

EXAMPLE 7

A phototypesetting photographic paper was prepared in the same manner as described in Example 5 using the following antistatic coating composition:

| Ingredient | Parts by Weight |
|---|---|
| Polystyrene sulfonic acid | 9.000 |
| Polyvinyl alcohol (88% hydrolyzed) | 9.000 |
| Glyoxal | 0.440 |
| Colloidal silica | 2.300 |
| Ammonium hydroxide | 0.600 |
| Hydrogen peroxide | 0.006 |
| Isobutyl alcohol | 9.600 |
| Water | 69.054 |
| | 100.000 |

The antistatic layer obtained from this composition was found to have a surface resistivity similar to that obtained in Example 5 and to be durable, abrasion resistant, non-tacky and insoluble in processing baths. The phototypesetting paper was found to be substantially free from staining and "black spots".

EXAMPLE 8

An antistatic coating composition was prepared in accordance with the following formulation:

| Ingredient | Parts by Weight |
|---|---|
| Polyvinyl sulfonic acid | 5.00 |
| Polyvinyl alcohol (88% hydrolyzed) | 5.00 |
| Glyoxal | 0.25 |
| Isobutyl alcohol | 9.60 |
| Water | 80.15 |
| | 100.00 |

Photographic supports were prepared by coating the above-described composition on polyethylene-coated paper at a coverage of 2.5 grams per square meter and drying at 140° F. to 230° F. by air impingement. The antistatic layer was found to have a surface resistivity of 8.5 log ohms at 20% relative humidity and a temperature of 73° F. It was also found to be durable, abrasion resistant and resistant to photographic processing solutions.

EXAMPLE 9

An antistatic coating composition was prepared in accordance with the following formulation:

| Ingredient | Parts by Weight |
|---|---|
| Polyacrylic acid | 6.5 |
| Polyvinyl alcohol (88% hydrolyzed) | 3.5 |
| Glyoxal | 0.1 |
| Surfactant[1] | 0.1 |
| Water | 89.8 |
| | 100.0 |

[1]The surfactant used was sodium p-tert-octyl-phenoxyethoxy-ethylsulfonate.

A photographic support was prepared by coating the above-identified composition on polyethylene-coated paper at a coverage of 1.5 grams per square meter and drying at 200° F. The antistatic layer was found to have a surface resistivity of 12.5 log ohms at 20% relative humidity and a temperature of 73° F. It exhibited excellent anticurl properties and was durable, abrasion resistant and resistant to photographic processing solutions.

The invention has been described in detail with particular reference to preferred embodiments thereof, but it will be understood that variations and modifications can be effected within the spirit and scope of the invention.

What is claimed is:

1. A photographic element comprising:
(1) a support;
(2) at least one radiation-sensitive image-forming layer; and
(3) an antistatic layer coated on said support which is durable, abrasion-resistant, non-tacky and resistant to leaching by aqueous processing baths employed in photographic processing; said antistatic layer having been formed by coating a liquid coating composition and drying the coating, said liquid coating composition comprising:
(a) a water-soluble film-forming polymeric anionic polyelectrolyte in free acid form;
(b) a water-soluble film-forming cross-linkable polyvinyl alcohol binder that reacts chemically with said polyelectrolyte during drying of said coating; and
(c) an acid-acting cross-linking agent that cross-links said polyvinyl alcohol binder during drying of said coating.

2. A photographic element of claim 1 wherein said support is polyethylene-coated paper.

3. A photographic element of claim 1 wherein said polyelectrolyte is a polymeric sulfonic acid.

4. A photographic element of claim 1 wherein said polyelectrolyte is polystyrene sulfonic acid.

5. A photographic element of claim 1 wherein said polyelectrolyte is polyvinyl sulfonic acid.

6. A photographic element of claim 1 wherein said liquid coating composition additionally comprises hydrogen peroxide.

7. A photographic element comprising:
(1) a support composed of paper coated on both sides with polyethylene;
(2) at least one radiation-sensitive image-forming layer on one side of said support; and
(3) an antistatic layer on the opposite side of said support which is durable, abrasion-resistant, non-tacky and resistant to leaching by aqueous processing baths employed in photographic processing; said antistatic layer having been formed by coating a liquid coating composition and drying the coating, said liquid coating composition comprising:
(a) a polymeric sulfonic acid;
(b) a water-soluble film-forming cross-linkable polyvinyl alcohol binder that reacts chemically with said polymeric sulfonic acid during drying of said coating; and
(c) an acid-acting cross-linking agent that cross-links said polyvinyl alcohol binder during drying of said coating.

8. A photographic element comprising:
(1) a support composed of paper coated on both sides with polyethylene;
(2) at least one radiation-sensitive image-forming layer containing a silver halide developing agent on one side of said support; and
(3) an antistatic layer on the opposite side of said support which is durable, abrasion-resistant, non-tacky and resistant to leaching by aqueous processing baths employed in photographic processing; said antistatic layer having been formed by coating a liquid coating composition and drying the coating, said liquid coating composition comprising:
(a) polystyrene sulfonic acid;
(b) a water-soluble film-forming cross-linkable polyvinyl alcohol binder that reacts chemically with said polystyrene sulfonic acid during drying of said coating;
(c) an acid-acting cross-linking agent that cross-links said polyvinyl alcohol binder during drying of said coating; and
(d) at least one antistaining agent selected from the group consisting of ammonium hydroxide, alkali metal hydroxides and stannous halides.

9. A photographic element comprising:
(1) a support composed of paper coated on both sides with polyethylene;
(2) at least one radiation-sensitive image-forming layer containing a silver halide developing agent on one side of said support; and
(3) an antistatic layer on the opposite side of said support which is durable, abrasion-resistant, non-tacky and resistant to leaching by aqueous processing baths employed in photographic processing;

said antistatic layer having been formed by coating a liquid coating composition and drying the coating, said liquid coating composition comprising:

(a) polystyrene sulfonic acid;

(b) a water-soluble film-forming cross-linkable polyvinyl alcohol binder that reacts chemically with said polystyrene sulfonic acid during drying of said coating;.

(c) an acid-acting cross-linking agent that cross-links said polyvinyl alcohol binder during drying of said coating; and (d) hydrogen peroxide.

10. A photographic base comprising a support coated with an antistatic layer which is durable, abrasion-resistant, non-tacky and resistant to leaching by aqueous processing baths employed in photographic processing; said antistatic layer having been formed by coating a liquid coating composition and drying the coating, said liquid coating composition comprising:

(a) a water-soluble film-forming polymeric anionic polyelectrolyte in free acid form;

(b) a water-soluble film-forming cross-linkable polyvinyl alcohol binder that reacts chemically with said polyelectrolyte during drying of said coating; and (c) an acid-acting cross-linking agent that cross-links said polyvinyl alcohol binder during drying of said coating.

11. A photographic base of claim 10 wherein said support is a photographic film support.

12. A photographic base of claim 10 wherein said support is a photographic paper support.

13. A photographic base of claim 10 wherein said support is a polyester film.

14. A photographic base of claim 10 wherein said support is a polyolefin-coated paper.

15. A photographic base of claim 10 wherein said support is paper coated on both sides thereof with polyethylene.

16. A photographic base of claim 10 wherein said polyelectrolyte is polystyrene sulfonic acid and said cross-linking agent is glyoxal.

17. A photographic base of claim 10 wherein said liquid coating composition additionally comprises hydrogen peroxide.

18. A coating composition for use in forming an antistatic layer in a photographic element, said composition comprising an aqueous solution of:

(1) a water-soluble film-forming polymeric anionic polyelectrolyte in free acid form;

(2) a water-soluble film-forming cross-linkable polyvinyl alcohol binder that reacts chemically with said polyelectrolyte during drying of said coating composition; and (3) an acid-acting cross-linking agent that cross-links said polyvinyl alcohol binder during drying of said coating composition.

19. A coating composition of claim 18 wherein said polyelectrolyte is polystyrene sulfonic acid and said cross-linking agent is glyoxal.

20. A coating composition of claim 18 additionally containing ammonium hydroxide and stannous chloride.

21. A coating composition of claim 18 additionally containing hydrogen peroxide.

22. A coating composition for use in forming an antistatic layer in a photographic element, said composition comprising:

(1) polystyrene sulfonic acid;

(2) polyvinyl alcohol;

(3) glyoxal;

(4) colloidal silica;

(5) ammonium hydroxide or an alkali metal hydroxide;

(6) hydrogen peroxide; and (7) water.

23. A method of providing antistatic protection for a photographic element, which comprises coating a surface of said element with an antistatic coating composition and drying the coating, said antistatic coating composition comprising an aqueous solution of:

(1) a water-soluble film-forming polymeric anionic polyelectrolyte in free acid form;

(2) a water-soluble film-forming cross-linkable polyvinyl alcohol binder that reacts chemically with said polyelectrolyte during drying said coating; and (3) an acid-acting cross-linking agent that cross-links said polyvinyl alcohol binder during drying of said coating.

24. A method of claim 23 wherein said polyelectrolyte is a polymeric sulfonic acid.

25. A method of claim 23 wherein said polyelectrolyte is polystyrene sulfonic acid and said cross-linking agent is glyoxal.

26. A method of claim 25 wherein said antistatic coating composition additionally contains colloidal silica.

27. A method of claim 25 wherein said antistatic coating composition additionally contains at least one antistaining agent selected from the group consisting of ammonium hydroxide, alkali metal hydroxides and stannous halides.

28. A method of claim 25 wherein said antistatic coating composition additionally contains ammonium hydroxide and stannous chloride.

29. A method of claim 25 wherein said antistatic coating composition additionally contains hydrogen peroxide.

30. A method of claim 25 wherein said antistatic coating composition additionally contains ammonium hydroxide and hydrogen peroxide.

* * * * *